United States Patent [19]

Nasu

[11] Patent Number: 4,527,789

[45] Date of Patent: Jul. 9, 1985

[54] WEB LAYING MACHINE

[75] Inventor: Nobuo Nasu, Fukuyama, Japan

[73] Assignee: Kabushiki Kaisha Kawakami Seisakusho, Hiroshima, Japan

[21] Appl. No.: 627,016

[22] Filed: Jul. 2, 1984

[30] Foreign Application Priority Data

Jul. 13, 1983 [JP] Japan ..... 58-128110

[51] Int. Cl.[3] ..... B65H 29/46

[52] U.S. Cl. ..... 270/31

[58] Field of Search ..... 270/31, 30

[56] References Cited

U.S. PATENT DOCUMENTS 2,980,421 4/1961 Deichmann ..... 270/31

3,094,319 6/1963 Deichmann ..... 270/31

4,177,980 12/1979 Melega ..... 270/31

FOREIGN PATENT DOCUMENTS 2023201 12/1979 United Kingdom ..... 270/31

*Primary Examiner*—E. H. Eickholt

[57] ABSTRACT

The web laying machine includes a stock material laying unit having a horizontal base and a pair of arms supporting a roll of stock material. The support arms are mounted on a pivotable casing which is rotatable through 180° about an axis by a pivotting motor mounted on a motor mounting plate, the drive shaft of the motor having a gear meshing with a gear of a pivot shaft. A speed control is also employed which assures a smooth operation and avoids shocks and distortion of the support arms and other members.

4 Claims, 15 Drawing Figures

FIG. 2A
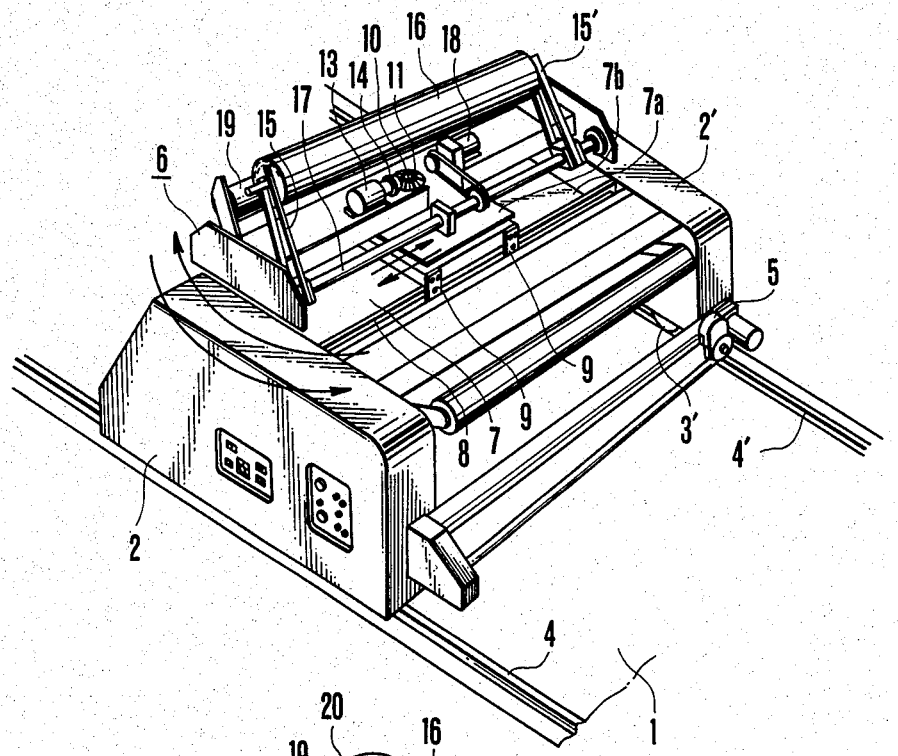
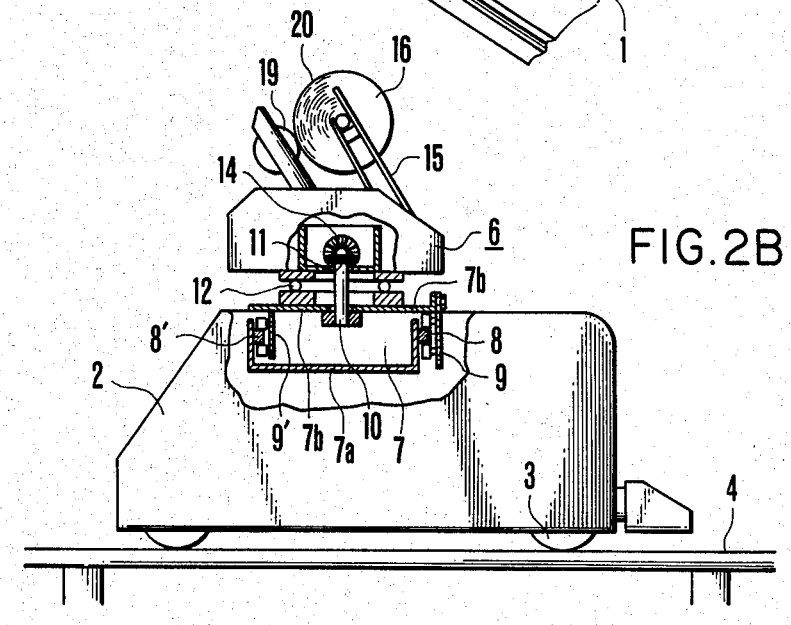
FIG. 2B

WEB LAYING MACHINE

BACKGROUND OF THE INVENTION

The invention relates to a web laying machine which is used to form superimposed layers of cloth to a given size or length on a laying table so that a plurality of sheets of cloth may be formed in one operation when cutting a stock material to a given pattern and size.

Several modes of laying a stock material are illustrated in FIG. 1. Specifically, FIG. 1A illustrates a laying operation in a zigzag-folded mode, FIG. 1B a laying operation in a simple mode in which the cloth is laid out in one direction, and FIG. 1C a laying operation in a face-to-face mode wherein a pair of adjacent superimposed layers have their front surfaces P facing toward each other and which thus is advantageous to cut a cloth into left and right portions of slacks according to a single paper pattern.

FIGS. 2A and 2B show one exemplary web laying machine of the prior art schematically, in a perspective view (FIG. 2A) and in a side elevation (FIG. 2B), partly broken away to show the section. The machine includes a laying unit 2 including a pair of sideplates 2' which are disposed in opposing relationship with each other and spaced apart by a given distance. Running wheels 3, 3' are mounted on the opposite sideplates toward their lower ends and engage a pair of rails 4, 4', respectively, which are disposed along the opposite lateral edges of a laying table 1. These wheels are adapted to be driven for rotation by an electric motor, not shown. The unit carries cutting means 5 on its front end, and also carries a pivotable casing 6 on its top which receives a stock material and which is rotatable about a vertical axis.

A horizontal base 7 extends across the pair of sideplates 2, 2', and includes a guide casing **7*a* which is channel-shaped in cross section, and a slide 7*b* which is slidable along the guide casing. The pivotable casing is mounted on and is supported by the horizontal base. The guide casing fixedly carries a pair of guide rails 8, 8' which are disposed on the front and the rear wall of the guide casing, respectively. A pair of brackets 9, 9' are mounted on the slide 7*b*** toward the front and rear ends thereof and each carry rollers which are disposed to hold an associated one of the guide rails therebetween for achieving a smooth sliding movement.

A pivot shaft 10 has its lower end fixedly mounted on the slide **7*b* and has its upper end extending into the pivotable casing where a bevel gear 11 is mounted thereon. A thrust bearing 12 is interposed between the pivotable casing and the slide 7*b* in surrounding relationship with the pivot shaft 10. A pivotting motor 13 is secured within the pivotable casing and has an output shaft on which a bevel gear 14 is fixedly mounted and is in meshing engagement with the bevel gear 11 on the pivot shaft. A roll of stock material 16 is received on a pair of support arms 15, 15' mounted on a support shaft 17 which can be rotated to a given angular position in response to a drive from a motor 18. A transfer roll 19 is adapted to be driven by drive means, not shown, and is urged into contact with the roll 16 suspended across the support arms 15, 15', thus allowing a cloth 20 to be paid off the roll 16**.

FIGS. 3A, B and C illustrate a laying operation in the face-to-face mode. The pivotable casing 6 is rotated through 180° for each reciprocating movement of the laying unit. In these Figures, numerals 21 and 22 represent conveyor belts which are disposed within the laying unit for conveying a cloth paid off from the roll. It will be seen that a tension regulating plate 23 is disposed along the path of movement of the cloth.

As will be seen, the pivotable casing 6 is rotated in response to a drive from the pivotting motor 13 which is transmitted through the output shaft 10 thereof and the bevel gears 14, 11. It will be noted that since the roll of stock material 16 is placed on the support arms 15, 15', a torque of an increased magnitude is required during the initial phase of the laying operation for its rotation. On the other hand, a force of inertia resulting from weights of the roll 16 and other components has a great influence upon the pivotable casing 6 and the slide **7*b*** toward the end of the rotation of the pivotable casing, causing a distortion of the support arms or other members or causing an offset in the position where the cloth begins to be paid off during a next cycle.

In the above description, it is assumed that the pivotable casing 6 is rotated through the engagement between the bevel gears which are mounted on the output shaft of the pivotting motor 13 which is secured to the casing and on the upper end of the vertical shaft which is stationary. However, alternatively, an annular gear may be secured to the slide **7*b* in surrounding relationship with the thrust bearing 12 and may be engaged by a suitable gearing which is coupled to the pivotting motor secured to the pivotable casing. Such arrangement may be reversed, namely, an annular gear may be mounted on the lower side of the pivotable casing while a pivotting motor may be secured to the slide 7*b***, in either instance, the problems mentioned above relating to the distortion of the support arms or other members or an offset in the position at the beginning of the payoff operation cannot be avoided.

Such problems can be alleviated by rotating the pivotting motor 13 at a very low speed of rotation, but this substantially degrades the production efficiency. While the rotation of the pivotting motor may be controlled in a stepwise manner during the full rotation thereof, this requires a complex control mechanism, resulting in an increased cost. While an electrical control may be contemplated, fluctuations in the voltage may give rise to an error. In addition, it should be noted that the roll of stock material 16 placed on the support arms 15, 15' has a weight which varies from as low as 8 kg to as high as 100 kg. Such weight continuously changes in the course of paying the cloth off the roll 16 in a gradual manner, whereby a high level of technology is required.

The invention intends to overcome the described problems. Specifically, while the pivotting motor is caused to rotate at a uniform rate, an arrangement is made such that the rotation of the pivotable casing takes place slowly during the initial phase, at an increased rate during intermediate positions thereof and again slowly toward the end of rotation, thus achieving an efficient operation. In addition, mechanical means is employed to achieve such a speed control which assures a smooth and accurate operation while avoiding shocks and while maintaining its manufacturing cost at a low value.

Above and other objects, features and advantages of the invention will become apparent from the following description with reference to the drawings which illustrate one embodiment of the invention.

BRIEF DESCRIPTION OF THE DRAWINGS

FIG. 2 shows an exemplary web laying machine, and specifically FIG. 2A shows a perspective view of the entire machine, and FIG. 2B a side elevation, partly broken away to show the cross section thereof;

DESCRIPTION OF EMBODIMENT

Figure 1A:
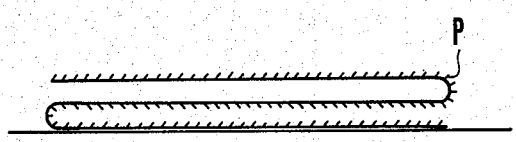
FIGS. 1A, B and C are schematic views illustrating laying operations in several modes.
Figure 1B:
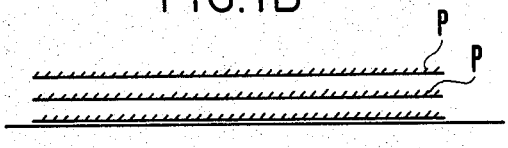
Figure 1C:
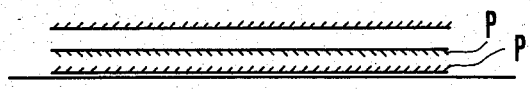
Figure 3A:
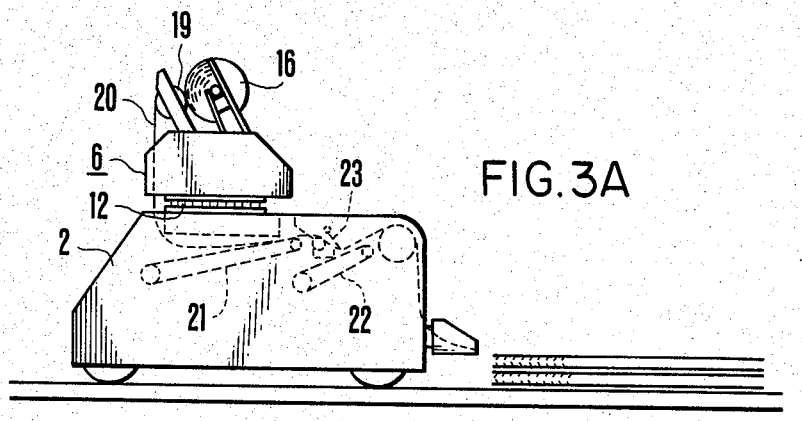
FIGS. 3A, B and C illustrate the laying operation in the face-to-face mode.
Figure 3B:
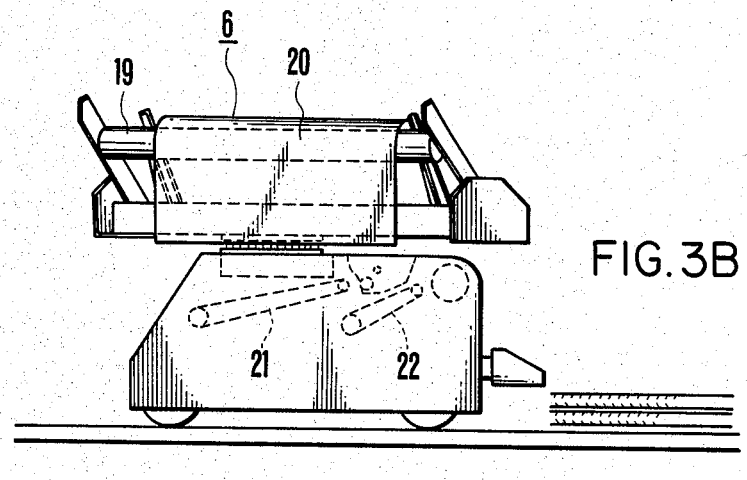
Figure 3C:
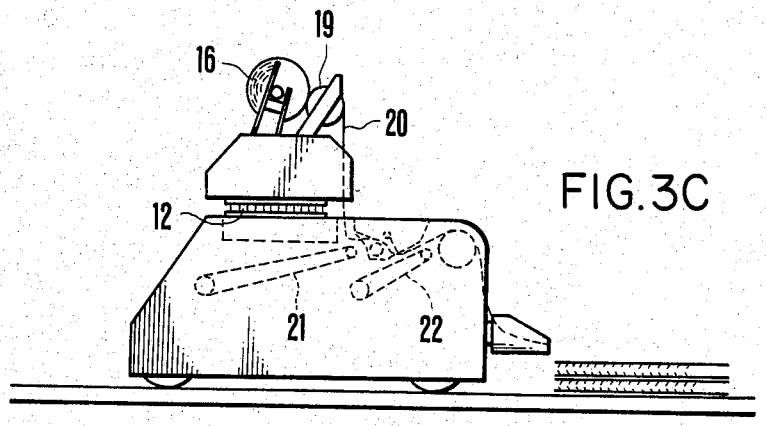
Figure 4:
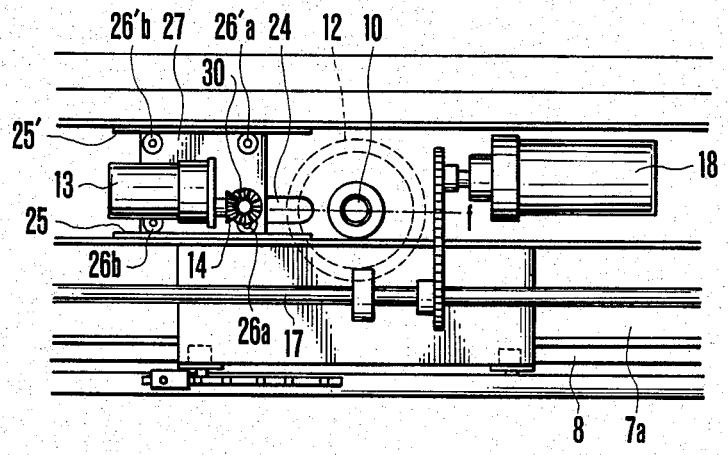
FIG. 4 is a plan view of a portion of an improved pivotable casing according to the invention which is located adjacent to the pivot shaft thereof.

In FIG. 4 and subsequent Figures, a pivotable casing 6, a slide *7b*, a pivot shaft 10 and a thrust bearing 12 remain the same as mentioned previously, with the pivot shaft 10 extending through the thrust bearing 12 and having its lower end integrally mounted on the slide *7b*. However, in the arrangement of the invention, a pivotting motor as illustrated at 13 in the conventional arrangement is not directly secured to the pivotable casing or the slide for causing a rotation of the pivotable casing 6.

Specifically, in the arrangement of the invention, a slit 24 of a given length is formed in the bottom of the pivotable casing in alignment with a line f which passes through the center of the pivot shaft 10. A pair of rails 25, 25' are mounted on opposite sidewalls of the pivotable casing which are located on the opposite sides of the slit 24. A plurality of rollers *26a, 26b, 26'a, 26'b* are mounted on a motor mounting plate 27 and engage the pair of rails 25, 25', thus allowing the motor mounting plate 27 to be slidable within the pivotable casing over a given distance. A pivotting motor 13 is mounted on the mounting plate 27. It is to be noted that the slit 24 extends close to the pivot shaft 10. A hollow shaft 28 secured to the motor mounting plate 27 is fitted through the slit 24 for sliding movement with the motor mounting plate 27. A drive shaft 29 extends through the hollow shaft 27 and fixedly carries a bevel gear 30 on its top end for meshing engagement with a bevel gear 14 which is mounted on the output shaft of the pivotting motor 13. On its lower end, the drive shaft fixedly carries a roller 31 disposed for sliding along a groove formed in a plate cam, to be described later, and a sprocket wheel 32 which meshes with a chain gear formed along the edge of the groove.

A plate cam 33 is horizontally mounted over the slide *7b* at a given elevation by means of studs, and is centrally formed with an arcuate or semi-circular recess 35 which extends around one-half the periphery of the thrust bearing 12. A generally cap-shaped guide groove 36 is formed in the cam plate so as to be symmetrically disposed with respect to the axis of the shaft 10, and a chain gear 37 is fixedly mounted on the upper surface of the plate cam 33 along the guide groove 36. It will be noted that the opposite skirts g, g' of the guide groove 36 are substantially rectilinear so as to be in alignment with the line f which passes through the slit 24 formed in the bottom of the pivotable casing and through the axis of the pivot shaft 10. The groove 36 is gently curved from its opposite ends toward the center k where it perfectly conforms to part of a circle. The chain gear 37 is similarly shaped and has its tooth face directed toward the guide groove. The chain gear is set in place by means of a bracket 38 and a set screw 39.

Figure 5:
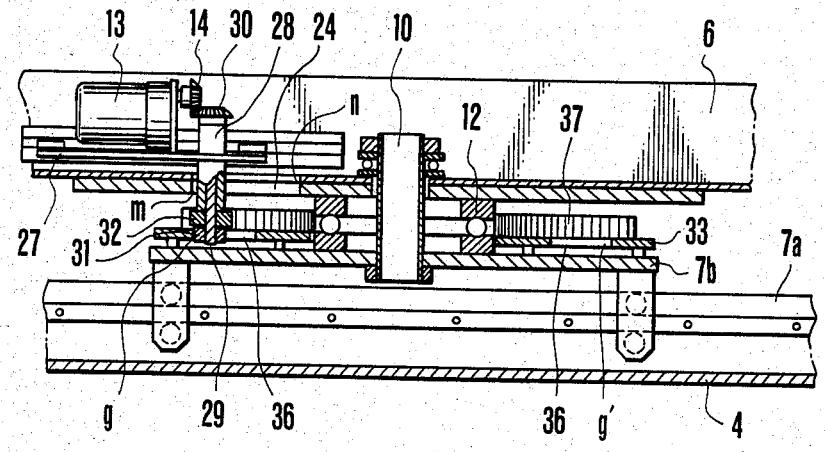
FIG. 5 is a longitudinal section of the pivotable casing shown in FIG. 4.
Figure 6:
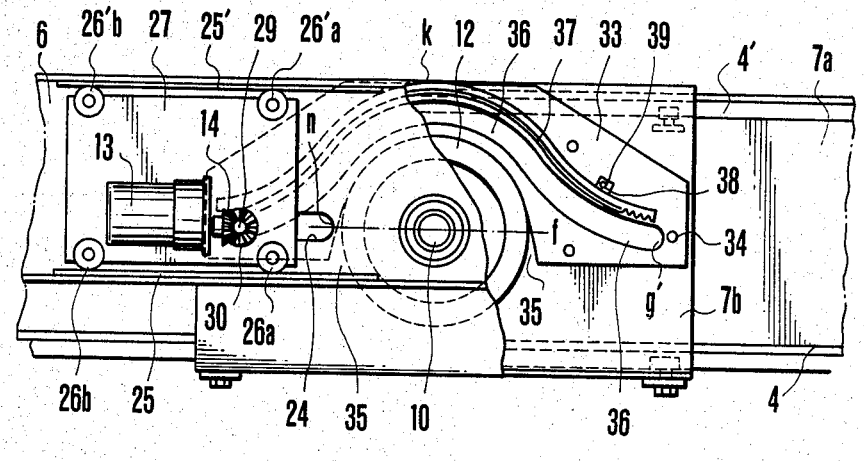
FIG. 6 is a plan view, partly broken away, illustrating the relationship between gear means and sliding means of a plate cam.

In the described arrangement, the roller 31 mounted on the lower end of the drive shaft 29 fits in the guide groove 36 formed in the plate cam 33 while the sprocket wheel 32 meshes with the chain gear 37. Before the pivotable casing 6 begins to rotate, the motor mounting plate 27 assumes its left-hand position shown in FIGS. 5 and 6 where it is most remote from the pivot shaft 10. At this time, the drive shaft 29 is located at the left end m within the slit 24 while the roller 31 and the sprocket wheel 32 are located to engage the left-hand skirt of the guide groove 36 and the chain gear 37, respectively.

Figure 7A:
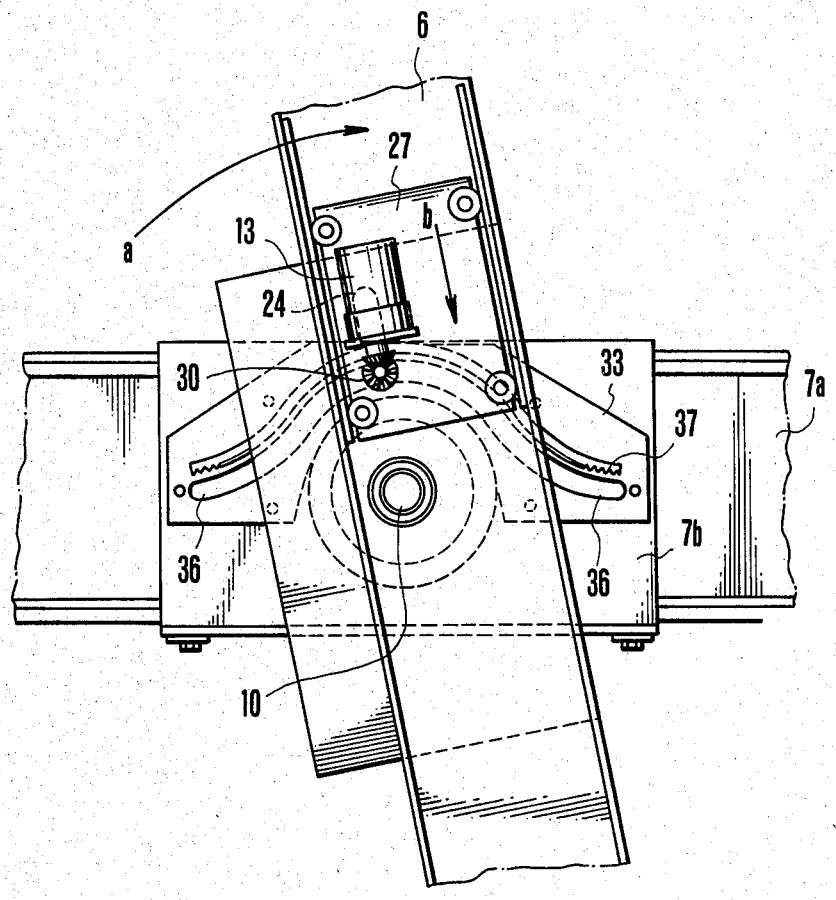
FIGS. 7A, B and C illustrate the operation.
Figure 7B:
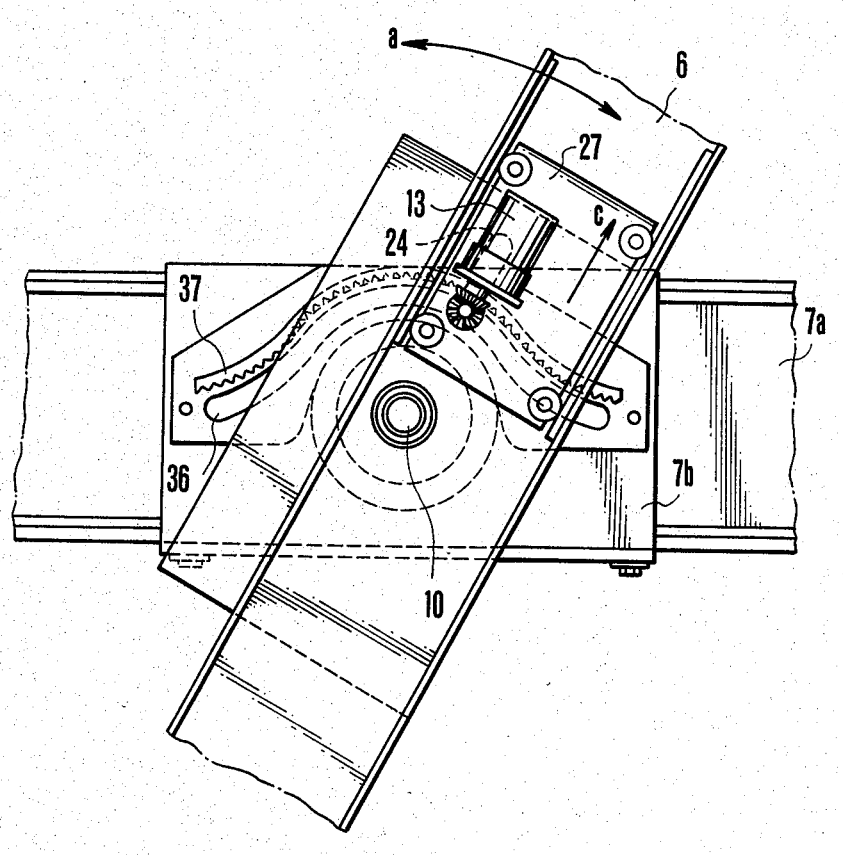
Figure 7C:
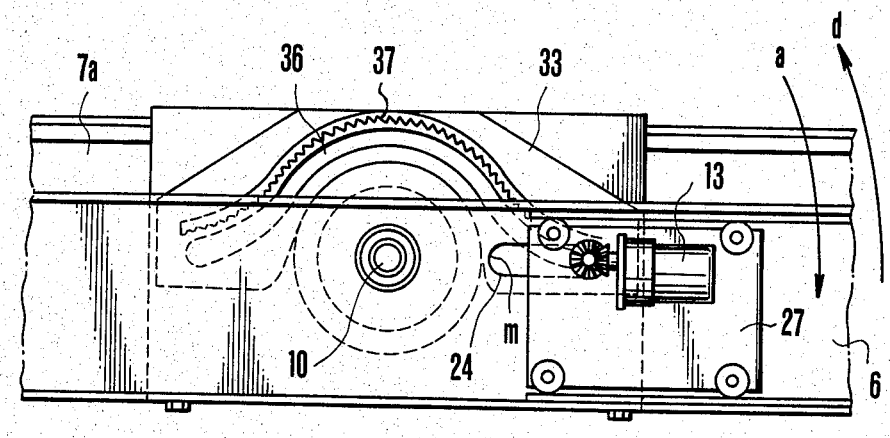

When the pivotting motor 13 is energized, the resulting rotation of the bevel gears 14, 30 causes the drive shaft 29 to rotate, whereby the meshing engagement between the sprocket wheel 32 and the chain gear 37 causes the pivotable casing 6 to rotate in a direction indicated by an arrow a, as indicated in FIGS. 7A and B. The motor mounting plate moves in a direction indicated by an arrow b until 90° position is reached, and then moves in a direction indicated by an arrow c when 90° position is passed. Toward the end of 180° rotation, a dog, not shown, which is mounted on the pivotable casing moves into contact with a limit switch, not shown, which is mounted on the slide to cease the energization of the pivotting motor 13, whereupon it completes the rotation through 180°, as indicated in FIG. 7C. It will be seen that the motor mounting plate 27 moves closest to the pivot shaft 10 when the pivotable casing 6 has rotated through 90°. Specifically, the drive shaft 29 is then located at the right end n within the slit 24, and thereafter it begins to retract to return to the position m within the slit 24. Accordingly, the surface of the cloth supplied from the roll of stock material, which is supported by the support arms 15, 15', is oriented in the opposite direction. Subsequently, the laying unit begins its running movement to perform a laying operation. When the pivotable casing 6 is to be rotated for the next time, the drive from the pivotting motor 13 in the opposite direction or in a direction indicated by an arrow c causes the arrangement to return to its original position. The rotation in these opposite directions take place alternately to achieve a laying operation in the face-to-face mode.

Figure 8:
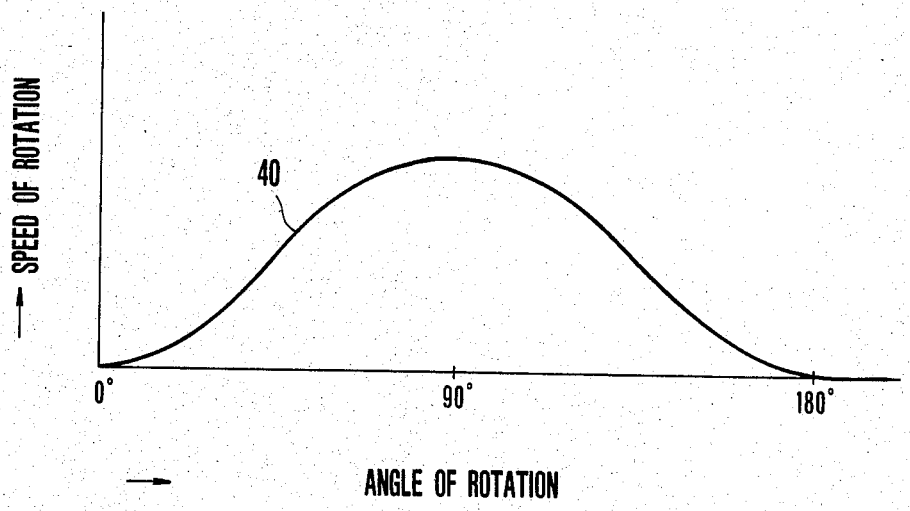
FIG. 8 graphically shows the relationship between the speed of rotation and the angle of rotation.

FIG. 8 graphically shows the relationship between the speed of rotation and the angle of rotation during the rotation of the pivotable casing 6. As indicated by a curve 40, the speed of rotation is low during the initial phase of rotation or when the angle of rotation is small, but the speed of rotation reaches its maximum as the angle of rotation increases toward the center position or 90°. Subsequently, the speed decreases gradually and becomes equal to zero at the end or 180° position where it comes to a stop. In this manner, shocks resulting from the inertia can be completely eliminated while achieving a rapid rotation toward the center position, with result that the entire time required for its rotation can be reduced, thus improving the operational efficiency.

It will be seen that the curve 40 is generally cap-shaped, conforming to the configuration of the guide groove 36 formed in the plate cam 33. Accordingly, any desired profile can be achieved for the speed of rotation by suitably configuring the guide groove 36 and forming the chain gear 37 in conformity therewith. A plurality of such assemblies can be provided.

In the described embodiment, the motor mounting plate 27 is mounted within the pivotable casing 6 while the plate cam 33 having the guide groove 36 or the chain gear 37 formed therein or mounted thereon is secured to the slide *7b*. However, it will be appreciated that a reverse arrangement may be used to achieve a similar effect. Alternatively, the chain gear mounted on the plate cam may be replaced by a toothed rod and the sprocket wheel may be replaced by a rack gear. The guide groove may be omitted in a small arrangement although its provision is preferred. As a further alternative, the chain gear or the toothed rod may include a hiatus. Other changes and modifications will readily occur to one skilled in the art.

Additionally it is to be noted that the arrangement of the invention which allows the slide *7b* to be slidable over the guide casing *7a* permits the selvage of a cloth laid out on the laying table to be freely aligned. This can be achieved in response to a drive from a separate motor, not shown, which is associated with one of the sidewalls of the laying unit.

What is claimed is:

1. A web laying machine including a laying unit having a horizontal base and a pair of support arms for receiving a roll of stock material, the pair of support arms being rotatable through 180° with respect to the horizontal base; characterized in that the pair of support arms are mounted on a pivotable casing having a bottom in which a slit of a given length is formed extending toward the axis of a pivot shaft around which the pivotable casing is rotatable, and further including a motor mounting plate having a pivotting motor mounted thereon and slidable over the slit, a drive shaft arranged to be driven by the motor and extending downwardly from the lower surface of the motor mounting plate to extend through the slit, gear means such as a sprocket wheel or a gear which is fixedly mounted on the lower end of the drive shaft, and meshing means in the form of a cap-shaped chain gear or a toothed rod mounted on the base so as to surround one-half the periphery of the pivot shaft.

2. A web laying machine according to claim 1, further including a roller or similar sliding means mounted on the lower end of the drive shaft, and a plate cam secured to the the horizontal base on which the meshing means is provided, the plate cam being also formed with a guide groove which is engaged by the roller or sliding means.

3. A web laying machine according to claim 1 in which the laying unit has a pair of sidewalls, and the horizontal base comprises a guide casing extending across the pair of sidewalls, and a slide which is slidable on the guide casing.

4. A web laying machine according to claim 2 in which the laying unit has a pair of sidewalls, and the horizontal base comprises a guide casing extending across the pair of sidewalls, and a slide which is slidable on the guide casing.

* * * * *